US011357336B2

(12) United States Patent
Quintino Rocha

(10) Patent No.: US 11,357,336 B2
(45) Date of Patent: Jun. 14, 2022

(54) NEWBORN SLEEP INSERT FOR BASSINETTE AND CRIB

(71) Applicant: Daniel Quintino Rocha, Brambleton, VA (US)

(72) Inventor: Daniel Quintino Rocha, Brambleton, VA (US)

(73) Assignee: BABYMAZING SOLUTIONS, LLC, Reston, VA (US)

( * ) Notice: Subject to any disclaimer, the term of this patent is extended or adjusted under 35 U.S.C. 154(b) by 72 days.

(21) Appl. No.: 16/575,026

(22) Filed: Sep. 18, 2019

(65) Prior Publication Data

US 2021/0076838 A1 Mar. 18, 2021
US 2021/0393047 A9 Dec. 23, 2021

Related U.S. Application Data

(60) Provisional application No. 62/733,031, filed on Sep. 18, 2018.

(51) Int. Cl.
*A47D 9/00* (2006.01)

(52) U.S. Cl.
CPC ..... *A47D 9/00* (2013.01)

(58) Field of Classification Search
CPC ..... A47D 9/00; A47D 13/02; A47D 15/008
See application file for complete search history.

(56) References Cited

U.S. PATENT DOCUMENTS 5,778,465 A * 7/1998 Myers ..... A47D 7/04 5/93.1
6,170,101 B1 * 1/2001 McCloud ..... A47D 15/008 5/424
7,404,219 B2 * 7/2008 Berkey ..... A47C 21/046 5/655
9,943,175 B1 * 4/2018 Spencer ..... A47D 9/00
2006/0075555 A1 * 4/2006 Komisar ..... A47D 15/008 5/946
2008/0271243 A1 * 11/2008 Burkholder ..... A47D 9/00 5/93.2

FOREIGN PATENT DOCUMENTS

GB 2501526 A * 10/2013 ..... A47D 7/04
WO WO-2018087798 A1 * 5/2018 ..... A47D 9/00

* cited by examiner

*Primary Examiner* — David R Hare
*Assistant Examiner* — Adam C Ortiz
(74) *Attorney, Agent, or Firm* — Jayne Marie Saydah

(57) ABSTRACT

A bassinette or crib sleep insert has converging sidewalls that are suspended around a top end of the bassinette or crib and terminate at a sleep surface at the bottom of the insert. Breathable cuddling bumpers are placed in the right location and with the right space to cuddle the baby. A wide lateral mesh window allows parents to see the baby through the mesh while lying in bed. Preferably, all material are soft and breathable, providing a safe environment for the baby.

8 Claims, 4 Drawing Sheets

*Fig.1:* is a perspective view of a first embodiment of a crib insert.

*Fig.2:* is a perspective view of a first embodiment of a crib insert installed within a crib.

*Fig.3:* is a top planar view a first embodiment of a crib insert.

NEWBORN SLEEP INSERT FOR BASSINETTE AND CRIB

BACKGROUND OF THE INVENTION

Field of Invention

The present invention relates to bassinettes or cribs, and more particularly for bedding.

Description of the Related Art

Newborn babies have trouble adapting to this new world and regularly have trouble sleeping in wide areas such as cribs and bassinettes. Current solutions are not always safe for keeping an infant in a desired sleeping position.

Parents of a newborn, on the other hand, suffer from sleep deprivation during the first months with a baby, which may result in other health problems.

Conventional bassinette and crib bedding that are available do not provide the cuddling feeling to soothe the baby because they are too wide in the sleeping area. In other products, parents will normally need to get up from their bed in order to check to see if their baby is sleeping safely, causing the parent to lose sleep more easily, and even make noise, waking up the baby or partner.

As can be seen, there is a need for an improved crib or bassinette insert where breathable cuddling bumpers are placed in the right location and with the right space to cuddle the baby. The wide lateral window allows parents to see the baby through the mesh while lying in bed. All material is breathable, providing a safe environment for the baby.

BRIEF SUMMARY OF THE INVENTION

An improved crib or bassinette insert, according to this disclosure comprises breathable cuddling bumpers that are placed in the right location and with the right space to cuddle the baby. Also, the insert may comprise a wide lateral window that allows parents to see the baby through the mesh while lying in bed. All material is breathable, providing a safe environment for the baby.

DETAILED DESCRIPTION OF THE INVENTION

The following detailed description is of the best currently contemplated modes of carrying out exemplary embodiments of the invention. The description is not to be taken in a limiting sense but is made merely for the purpose of illustrating the general principles of the invention. Broadly, embodiments of the present invention provide an improved bassinette and crib insert that reduces the sleep supporting area that the baby will sleep on, making them feel safer.

The insert includes padded lateral cushions 3, named breathable cuddling bumpers, providing an additional cuddling feeling to the newborn. The insert surroundings and pad are made of a breathable material, making it a safe environment for the baby.

The insert has a wide "see-baby" window formed of a mesh that allows parents to see the baby without having to get up in bed, improving parents sleep. The insert has a tapered, inwardly converging side wall that narrows towards the flat sleeping surface. The sleeping surface, called anatomical pad, enables the baby to be placed on either side of the bassinet or crib insert, and has safe lateral support cushions to the baby. The insert is made of breathable material, making it a safe environment to the baby. The breathable cuddling bumpers are placed in the right location and with the right space to cuddle the baby. The wide lateral window allows parents to see the baby through the mesh while lying in bed. All material in breathable, providing a safe environment for the baby.

Figure 1:
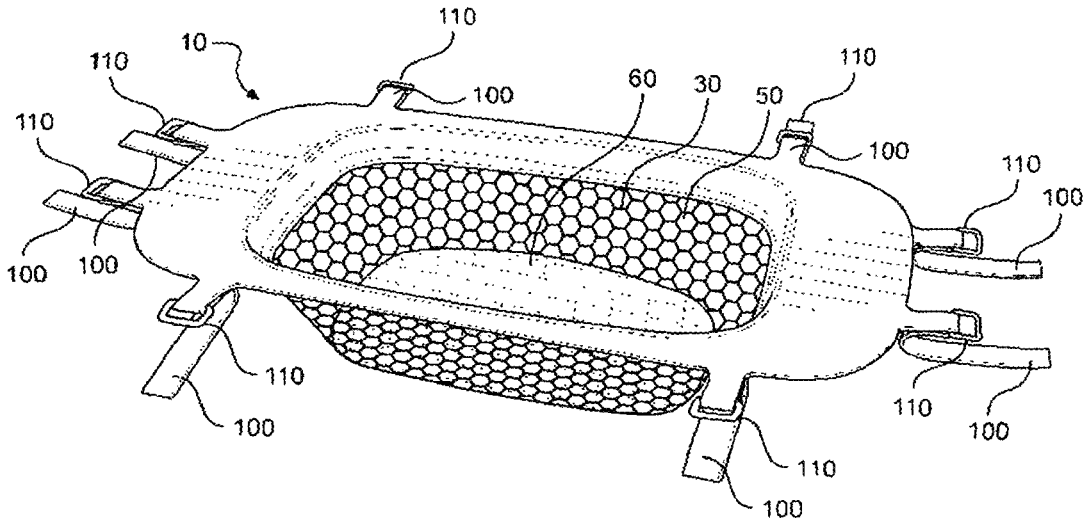
FIG. 1: is a perspective view of a first embodiment of a crib insert.
Figure 2:
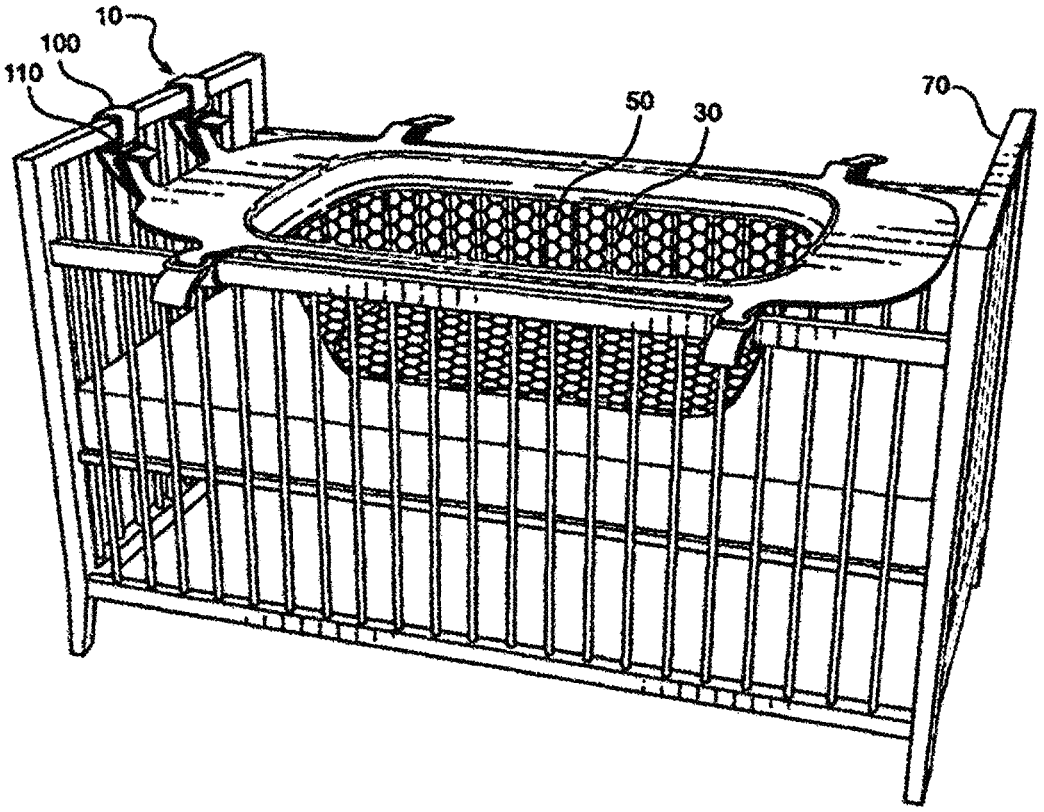
FIG. 2: is a perspective view of a first embodiment of a crib insert installed within a crib.
Figure 3:
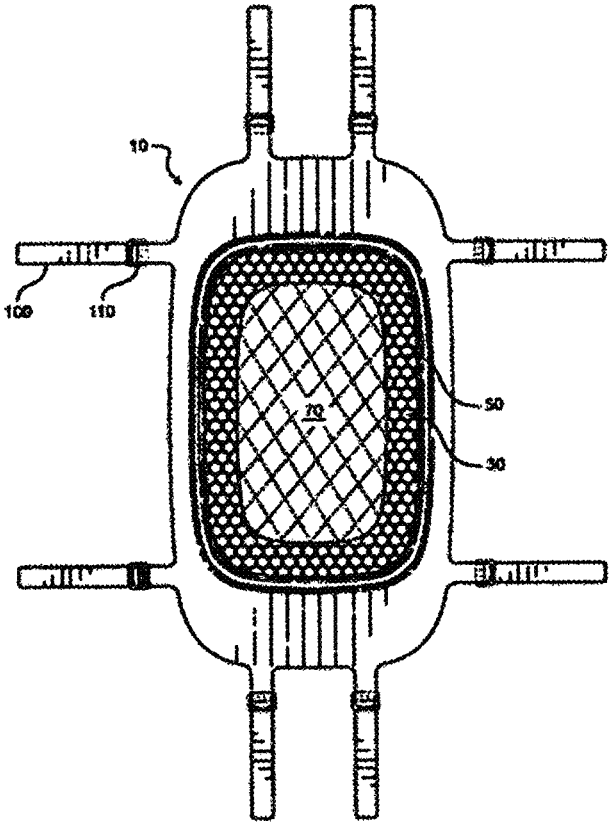
FIG. 3: is a top planar view a first embodiment of a crib insert.
Figure 4:
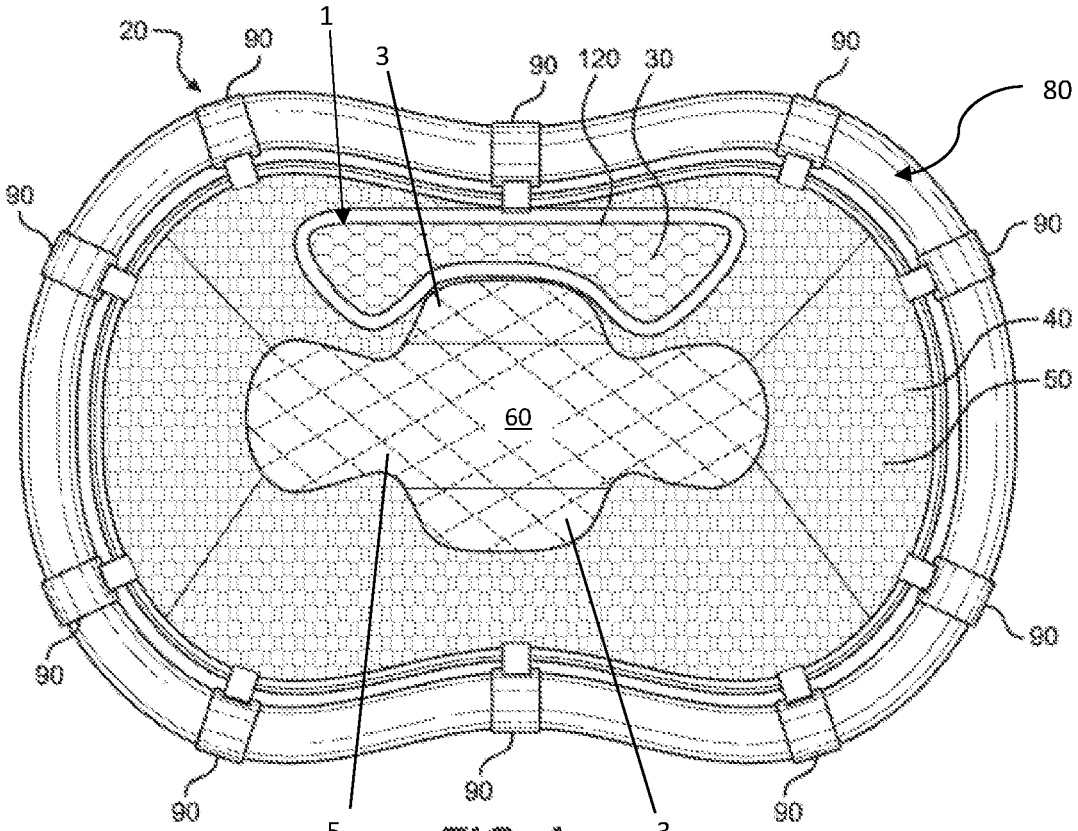
FIG. 4: is a top planar view a second embodiment of a bassinette insert.
Figure 5:
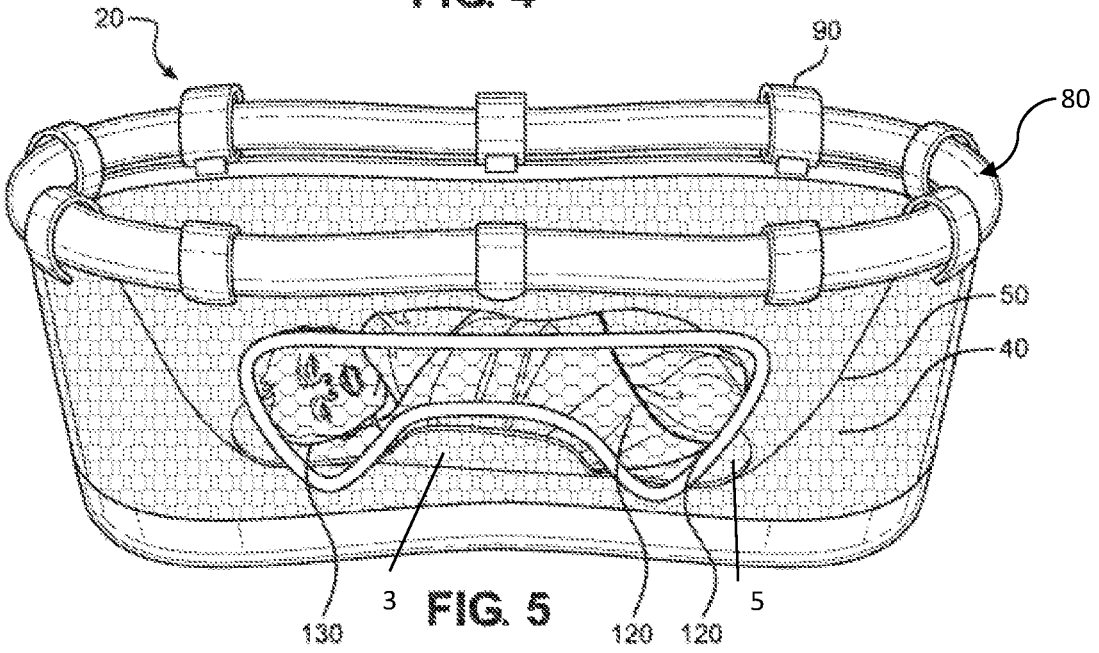
FIG. 5: is a side perspective view of a bassinette insert in use.

As seen in reference to the drawings, where like numbers are used to refer to like items throughout, there is shown in FIGS. 1-3 a first embodiment, according to this disclosure, of an insert 10 in a crib 70, and there is shown in FIGS. 4-5, a second embodiment, according to this disclosure, of an insert 20 in a bassinet 80. As shown in FIGS. 4-5, the insert 20 of the present invention may include: a wide see-through lateral window 120; a double-sided anatomic pad 3; a breathable cuddling bumper 50; a natural hypoallergenic tencel mesh in pad; a cotton pad surface 5; and breathable 3D mesh 40 in surroundings.

The 100% breathable 3D mesh 50 is installed inside the bassinet or crib, comprising the surrounding of the insert 10, 20. It is attached to the bassinet 80 or crib 70 with a plurality of plastic buckle hooks 90 or straps 100 and rings 110, respectively, at the top. The breathable mesh 50 is stitched to the double-sided anatomic pad 60. The anatomic pad 60 has a plurality of layers to provide a comfortable, breathable and hypoallergenic surface. The top layer 5, in contact with the baby 130, is preferably a 100% cotton fabric. Below the top layer 5 is a layer of natural hypoallergenic Tencel mesh, which enables air circulation to the pad. Along both sides of the center of the pad, there are the breathable cuddling bumpers 3. The wide see-baby lateral window 120 can be on one or both sides of the insert, stitched to the 3D mesh 50.

The insert is installed inside the bassinet 80 or with buckles that will be attached to the top bars of the bassinet 80 or crib 70. The pad 60 will lay on top of the bassinet or crib mattress, providing a narrower and flat surface for the baby to sleep. When placing the baby in the insert, both breathable cuddling bumpers 3 will touch the arms and sides of the baby, providing a feeling of being cuddled. The wide see-baby lateral window 120 will enable parents to see the baby through the mesh 30.

Once the plastic buckles 90, 3D air mesh 50, cotton, Tencel fabric, and polyester are procured, one can cut to the appropriate sizes and stitch them together to make the insert 10, 20. The buckles 90 will be at the top side of the mesh 50. The layers of the pad will be stitched at the bottom of the mesh 50. It is important to follow the correct measurements in order to achieve the cuddling feeling and still have a safe environment for the baby. The filling of the cuddling bumpers should be a layer of 3D mesh to maintain its breathability.

The wide see-baby window 120 can be bigger, smaller, on both sides or on each of the sides of the insert 10, 20. The attachment to the bassinet or crib can be done with plastic buckles 90 or any other device that will hold the insert in place. The pad can be of an organic material or with different fabrics. The shape of the pad can be different. The cuddling bumpers 3 could have different height and width. The 3D mesh 50 could be of other breathable material.

The following is a list of the numerals utilized in FIGS. 1-5

3 are lateral cushions named breathable cuddling bumpers;
5 is a top layer of the anatomical cushion or pad 60;
10 is a first embodiment of an insert in a crib;
20 is a second embodiment of an insert in a bassinette;
30 is window mesh;
40 is the bassinette wall;
50 is 3d mesh of the bassinette insert;
60 is the anatomical cushion or pad;
70 is a crib;
80 is a bassinet;
90 are hooks;
100 are straps;
110 are rings;
120 is a see-baby window; and
130 is a baby.

It should be understood, of course, that the foregoing relates to exemplary embodiments of the invention and that modifications may be made without departing from the spirit and scope of the invention as set forth herein.

ITEMIZED PARTS LIST

10: is a first embodiment.
20: is a second embodiment.
30: is window mesh.
40: is 3d mesh.
50: are breathable cuddle bub bumper walls.
60: is the anatomical cushion.
70: is a crib
80: is a bassinet
90: are hooks
100: are straps
110: are rings
120: is a see-baby window
130: is a baby

What is claimed is:

1. A baby receiving apparatus for insertion into a bassinette, the apparatus comprising:
an anatomic pad configured to support a baby, the anatomic pad including
a flat surface extending longitudinally between a pair of longitudinally extending lateral sides, the flat surface configured for a baby to rest thereon, and
first and second cushions extending vertically such that the first and second cushions are higher than the flat surface, the first cushion connected to one side of the pair of longitudinally extending lateral sides, the second cushion connected to a second side of the pair of longitudinally extending lateral sides, the first and second cushions laterally and vertically spaced apart, and the first and second cushions configured to touch a lateral portion of a torso or an arm of the baby;
a sidewall surrounding the anatomic pad, the sidewall being tapered, inwardly, such that the sidewall narrows from an upper portion towards a lower portion which is connected to the flat surface and the first and second cushions; and
a plurality of attachments connected to the upper portion of the sidewall, the plurality of attachments configured to attach to the bassinette.

2. The apparatus of claim 1, wherein the sidewall further comprises:
at least one see-through window configured to allow the baby to be seen through the sidewall.

3. The apparatus of claim 2, wherein the sidewall comprises a 3-dimensional mesh and the at least one see-through window comprises a see-through mesh through which the baby can be seen from outside the bassinette.

4. The apparatus of claim 2, wherein the at least one see-through window is surrounded by the sidewall and positioned above the flat surface, and the window includes a lower boundary that extends longitudinally above a height of the first cushion and longitudinally below the height of the first cushion, wherein the lower boundary that extends longitudinally below the height of the first cushion is configured to allow a head or a leg of the baby to be seen through the window.

5. The apparatus of claim 1, wherein the sidewall further comprises:
a breathable mesh fabric and a see-through mesh fabric, the breathable mesh fabric defining a window in the sidewall, and the at least one see-through mesh fabric within the see-through window.

6. A baby receiving apparatus for insertion into a bassinette, the apparatus comprising:
an anatomic pad including an upper surface and a lower surface, the upper surface configured to support a baby, and the lower surface configured to abut a bed in the bassinette;
a 3-dimensional mesh side wall extending vertically and surrounding the pad, the 3-dimensional mesh sidewall being tapered, inwardly, such that the sidewall narrows from an upper portion towards a lower portion which is connected to the pad, wherein the anatomic pad further comprises:
a flat surface extending longitudinally between a plurality of cushions, the flat surface connected to the 3-dimensional mesh sidewall and the plurality of cushions, and the flat surface configured for the baby to rest thereon;
each cushion of the plurality of cushions extending laterally from the flat surface, each cushion connected to the flat surface and the sidewall, each cushion of the plurality of cushions extending both vertically above the flat surface and laterally from the flat surface towards the sidewall;
a plurality of attachments connected to the upper portion of the 3-dimensional mesh side wall, the plurality of attachments configured to attach to the bassinette; and
an elongated, see-through window disposed in the 3-dimensional mesh sidewall, the window configured to allow the baby to be seen through the side wall.

7. The apparatus of claim 6, wherein the window comprises a see-through mesh and the window is entirely surrounded by the 3-dimensional mesh sidewall.

8. The apparatus of claim 6, wherein each cushion of the plurality of cushions is configured to touch a torso or arm of the baby that is placed on the anatomic pad.

* * * * *